US005675660A

United States Patent [19]

Townsend

[11] Patent Number: 5,675,660

[45] Date of Patent: Oct. 7, 1997

[54] APPARATUS FOR PROTECTING MICROPHONES

[76] Inventor: Brook Lowell Townsend, 8 Crescent Ct., Midland, Mich. 48640

[21] Appl. No.: 591,752

[22] Filed: Jan. 25, 1996

[51] Int. Cl.[6] ..... H04R 25/00

[52] U.S. Cl. ..... 381/169; 381/168; 381/189

[58] Field of Search ..... 381/168, 189; 181/242

[56] References Cited

U.S. PATENT DOCUMENTS

| | | | |
|---|---|---|---|
| 4,065,648 | 12/1977 | Cvetko et al. | 381/168 |
| 5,444,790 | 8/1995 | Kogen | 381/168 |

OTHER PUBLICATIONS

Photographs (three) of microphone screen, model A81G made by Shure Corporation (admitted prior art).

*Primary Examiner*—Sinh Tran

*Attorney, Agent, or Firm*—Pravel, Hewitt, Kimball & Krieger

[57] ABSTRACT

A cover for protecting a microphone includes a shield and coupling member. The coupling member is tubular with an inner surface slightly larger than the housing portion of the microphone. The shield is tubular and large enough to protect the microphone portion of the microphone assembly without interference. The shield includes one end having a threaded inner surface for coupling to the threaded outer surface of the coupling member. The threaded portion of the coupling member includes longitudinal slots for forming resilient fingers. The shield threaded surface is tapered so that the fingers wedge against the handle when the coupling member is tightened to the shield.

21 Claims, 2 Drawing Sheets

FIG. 1
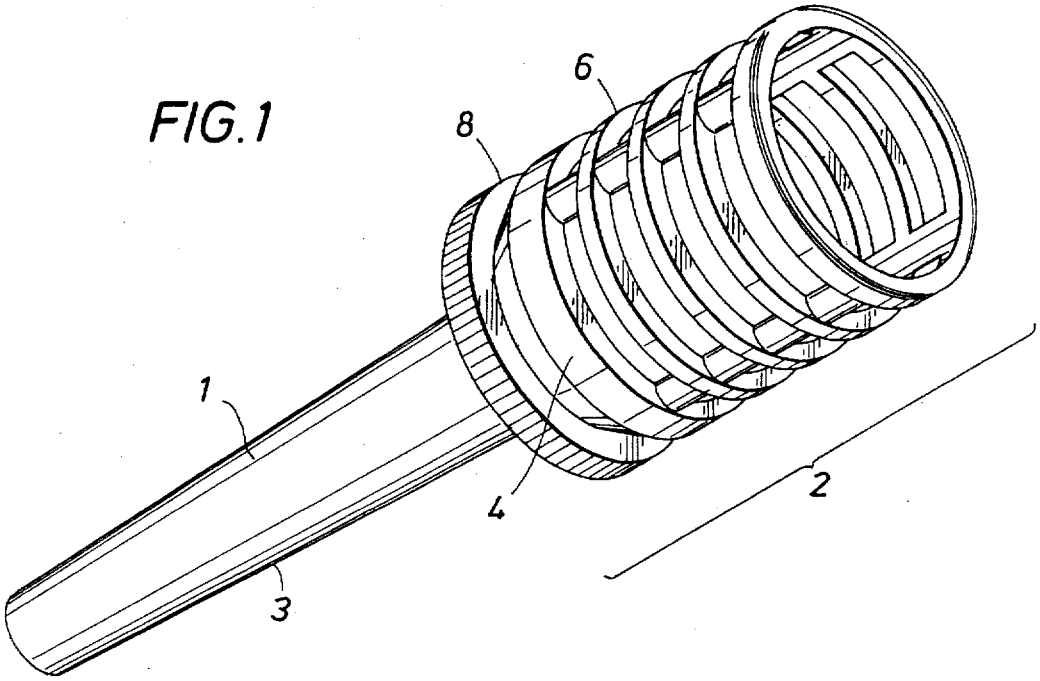
FIG. 2A
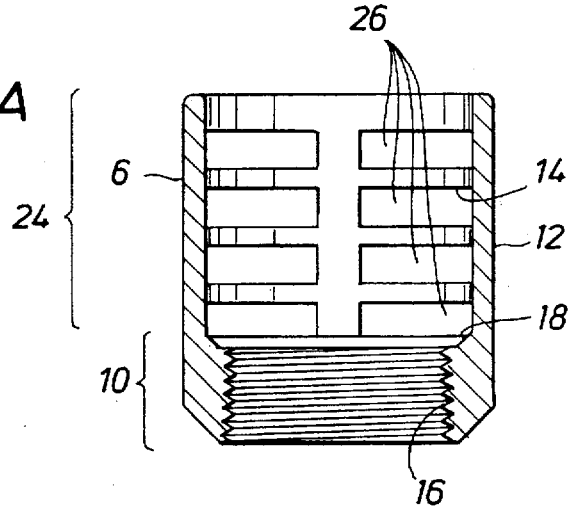
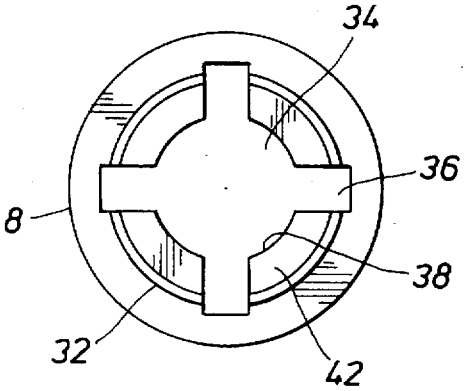
FIG. 2C
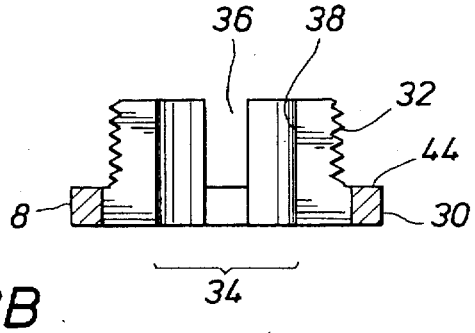
FIG. 2B

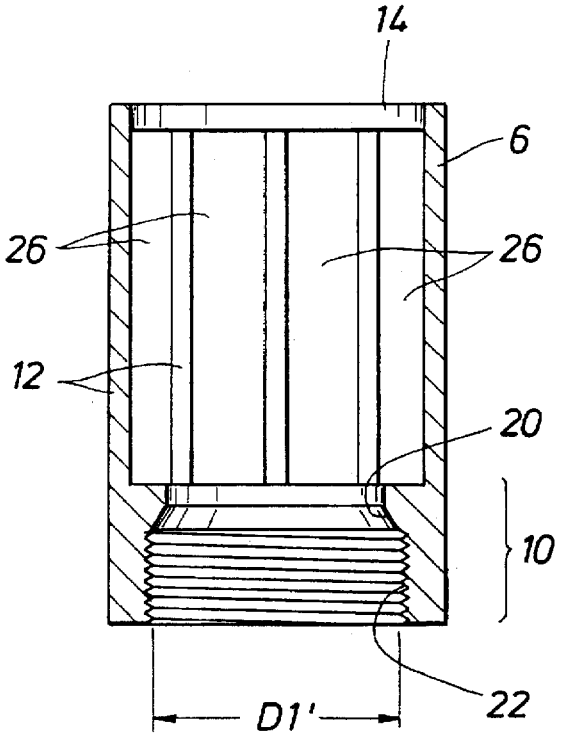
FIG. 3A
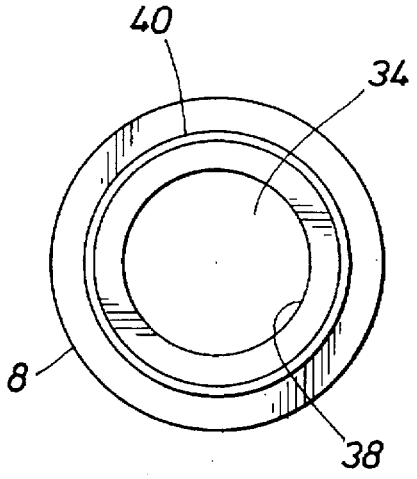
FIG. 3D
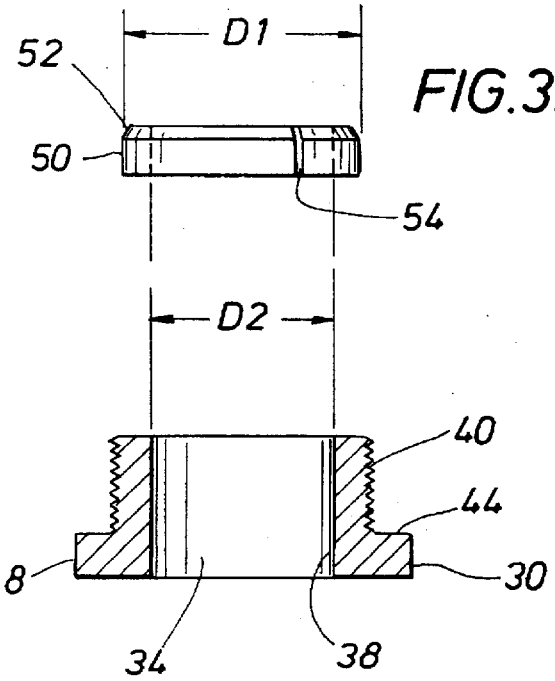
FIG. 3B
FIG. 3C

APPARATUS FOR PROTECTING MICROPHONES

BACKGROUND OF THE INVENTION

1. Field of the Invention

The invention relates to an apparatus for protecting a microphone.

2. Description of the Related Art

Microphones are an integral piece of equipment for today's musician. A microphone assembly consists of a microphone attached to a housing or handle. The microphone converts sound into electrical signals. A thin metallic screen usually surrounds the microphone to protect it from damage. However, the thin metallic screen is not adequate to protect the microphone from certain types of impacts.

Most of the damage associated with microphone assemblies is related to the microphone. Sometimes the microphone assembly is accidentally dropped during handling. More often though, the microphone assembly is simply located where damage is inevitable, if not highly likely. For example, when a microphone assembly is used to pick up drum or cymbal sounds. In these cases the microphone is often subjected to accidental striking from drum sticks.

In the past, a protective cage was developed with coat hanger wire, or wire and tape. Sometimes if the tape was improperly placed, the free flow of air around the microphone was hindered, thereby causing phase problems. So these solutions are not adequate to maintain high quality sound reproduction.

Furthermore, if the microphone was seriously damaged, the only solution left was to send the microphone back to the factory or to a repair shop, where the microphone would be repaired at roughly 33–75% of the cost of a new microphone.

Therefore, since present solutions are either inadequate or costly, it is desirable to overcome this deficiency of present day microphones.

SUMMARY OF THE PRESENT INVENTION

A protective cover is provided for preventing damage to a microphone without interfering with the operation or sound reproduction of the microphone. A microphone assembly includes a microphone connected to a handle or housing. According to the preferred embodiment, the cover includes a shield portion and a coupling member for protecting the microphone. The coupling member is conveniently tubular for receiving the housing of the microphone assembly. The shield is also tubular and is placed over the microphone and coupled to the coupling member. When the shield and coupling member are coupled together, a compression or wedging mechanism causes the cover to frictionally attach to the housing. The point of attachment is very flexible and allows the cover to encompass the microphone without being in physical communication with it.

In the preferred embodiment, the coupling is comprised of a threaded and tapered connection. The shield and the coupling member are matably threaded. The shield having threads on an inner surface and the coupling member having threads on an outer surface of a plurality of resilient fingers. The surfaces being tapered so that the resilient fingers of the coupling member are compressed inward as the coupling member is threaded into the shield. Longitudinal slots in the wall of the coupling member permit the threaded portion to contractively wedge against the housing as the coupling member is threadably tightened into the shield.

The convenient two piece design allows a single shield to be used with a variety of different sized microphones. The inner diameter of the coupling member can be fashioned to support a number of different microphones, each coupling member having a particular diameter for a particular microphone. Therefore, the two piece design allows the protective cover to be adapted to a wide variety of existing and future microphones.

An alternative embodiment includes a coupling member utilizing untapered threads. The shield and coupling member each have threads on untapered surfaces. At the interior end of the inner surface where the thread terminates, the shield includes a inwardly tapered surface. A gapped collar is provided having a tapered outer surface at one end and an inner diameter slightly larger than the microphone housing. The outer diameter of the collar is slightly smaller than the inner diameter of the shield's inner surface. The collar is received into the shield coupling with the tapered surfaces engaging. As the coupling member and shield are screwed together, the end of the coupling member engages the untapered end of the collar and causes the tapered end of the collar to wedge against the inwardly tapered surface of the shield and constrict in diameter. Thus, when the microphone housing is received into the coupling, the constricting collar attaches the cover to the microphone.

BRIEF DESCRIPTION OF THE DRAWINGS

A better understanding of the present invention can be obtained when the following detailed description of the preferred embodiment is considered in conjunction with the following drawings, in which:

FIG. 1 is a diagram illustrating a microphone having a protective cover according to the preferred embodiment;

FIG. 2A is a cross-sectional side view illustrating the shield portion of the protective cover according to the preferred embodiment;

FIG. 2B is a cross-sectional side view illustrating the coupling member of the protective cover according to the preferred embodiment;

FIG. 2C is a top view of the coupling member according to the preferred embodiment;

FIG. 3A is a cross-sectional side view illustrating the shield of the protective cover according to the alternative embodiment;

FIG. 3B is a side view illustrating a collar of the protective cover according to the alternative embodiment;

FIG. 3C is a cross-sectional side view illustrating the coupling member of the protective cover according to the alternative embodiment; and FIG. 3D is a top view of the coupling member according to the alternative embodiment.

DETAILED DESCRIPTION OF THE PREFERRED EMBODIMENT

Referring now to FIG. 1, there is illustrated a microphone assembly 1 fitted with a protective cover 2 according to the preferred embodiment of the present invention. The microphone assembly 1 is a conventional microphone, such as a Shure SM57, used in the music performance and recording industry. A typical microphone assembly 1 includes a handle or housing section 3 and a microphone 4 extending from one end of the housing 3. The microphone 4 is the device that receives sound and converts it into electrical signals.

The cover 2 includes a tubular shield 6 and a tubular coupling member 8. The shield 6 is sound permeable and conveniently surrounds the microphone 4 to guard it from potentially damaging contact, such as from drumsticks or mishandling. The coupling member 8 attaches the shield 6 to the housing 3 of the microphone assembly 1 preferably at a point below the microphone 4 so as not to interfere with the operation of the microphone. The cover 2 is conveniently tubular shaped to fit a variety of microphone assemblies, although flat or partially rounded variants also provide protection in certain circumstances. Other shapes are contemplated to fit other microphone assemblies, such as spherical or boxed shapes. Of course, the cover 2 can be adapted to fit special microphones. The cover 2 is preferably constructed of sturdy but resilient material, such as plastic, or polypropylene, which provides adequate impact protection without introducing significant adverse noise if the cover is struck while the microphone is operational.

Now referring to FIG. 2A there is illustrated a cross section of the shield 6 according to the preferred embodiment. The tubular shaped shield 6 has a plurality of holes or openings 26 for sound to pass through. One end of the shield 6 includes an annular receptacle 10 having an inwardly tapered axial bore 16 which is threaded for coupling to the coupling member 8. The end opposite receptacle 10 is preferably open, but alternative embodiments are contemplated having closed or partially closed ends.

The structure of the shield 6 is useful to prevent contact with the microphone and allow sound to pass through without significant audible degradation. Sound passes through the plurality of openings 26 which are formed by a plurality of intersecting equally spaced radial 14 and longitudinal 12 members. The tubularly shaped shield 6 is conveniently formed with an inner diameter substantially larger than the diameter of the microphone 4. This allows for some deformation of the shield 6 while still preventing contact with the microphone 4 during impact. An integrally molded stress relief 18 is provided at an interior angle formed where the longitudinal members 12 intersect the base 10 to provide further structural support from impact forces. Other structural variations are contemplated to provide the characteristics described herein.

Now referring to FIGS. 2B and 2C there are illustrated a cross section and top view respectively of the coupling member 8. The tubular shaped coupling member 8 comprises a plurality of equally spaced longitudinal resilient fingers 42 integrally connected to an annular knurled grip 30. The resilient fingers 42 are separated by longitudinal openings 36 to allow the fingers to bend inwardly under pressure. Each of the resilient fingers 42 have an inner surface 38 and a threaded outer surface 32. The inner surfaces 38 extend the length of the coupling member 8 and combine to form a bore 34. The diameter of the bore 34 is slightly larger than the diameter of the housing 3 so that the housing can be slidably received into the bore 34. Thus, because the coupling member 8 is a separate piece from the shield 6, the cover 2 can be adapted to a wide variety of microphone sizes simply by using a coupling member 8 having a correspondingly sized bore 34, i.e., the coupling members 8 are interchangeable.

The threaded outer surface 32 terminates into the annular grip 30 thereby forming a shoulder 44 and has a diameter substantially equal to the largest inner diameter of the inwardly tapered bore 16. The inwardly tapered bore 16 and the outer surface 32 cooperate to constrict to diameter of the bore 34 as the coupling member 8 is threaded into to the shield 6. The plurality of longitudinal slots 36 permit the bore 34 to constrict, i.e., the resilient fingers 42 press inward as the coupling member 8 is threaded into the shield 6.

In the mounting of the cover 2, the coupling member 8 slidably receives the microphone assembly 1 into the bore 34. The coupling member is positioned on the housing 3 near the microphone 4, but preferably not contacting the microphone. This prevents the cover 2 from possibly causing any damage to the microphone 4. The knurled grip 30 is on the distal end of the coupling member 8 away from the microphone 4. It is noted that the positioning of the cover 2 is very flexible and can be adapted to suit the user's preferences. The shield 6 is then placed over the microphone 4, receptacle 10 end first, and received onto the coupling member 8. As the shield 6 is threadably tightened onto the coupling member 8, the resilient fingers 42 compress against the housing 3, thereby causing a snug frictional fit. Thus, the cover 2 provides protection to the microphone without interfering with its operation.

Now referring to FIGS. 3A–3D, there is illustrated an alternative embodiment of the protective microphone cover 2. In FIG. 3A there is illustrated the tubular shield 6 having an annular receptacle 10 with a threaded axial bore 22 terminating into an inwardly tapered end 20. A plurality of openings 26 are provided in the shield 6 by intersecting longitudinal 12 and radial 14 members. The radial member 14 in combination with the longitudinal members 12 provide the necessary structural support to guard the microphone from impact.

Now referring to FIG. 3C there is illustrated a tubular coupling member 8 having an inner surface 38 and a threaded outer surface 40. The inner surface 38 extends the length of the coupling member 8 to form a bore 34. The diameter of the bore 34 is slightly larger than the diameter of housing 3 so that the housing can be slidably received into the bore. The coupling member 8 is interchangeable to fit a variety of microphones, as in the preferred embodiment. The threaded outer surface 40 terminates into an annular knurled grip 30 thereby forming a shoulder 44. The threaded outer surface is mated to the threaded axial bore 22. FIG. 3D shows the coupling member 8 and illustrates the relative diameters of the bore 34, the inner surface 38 and the external threads 40.

Now referring to FIG. 3B, there is illustrated a side view of a collar 50. The collar 50 is formed from a sturdy but resilient material, such as plastic or polypropylene. A gap 54 in the collar permits its inner diameter D2 to constrict as pressure is applied. An outer diameter D1 of the collar is slightly less than the inner diameter D1' of the receptacle 10 so that the collar 50 can fit into the receptacle 10 and against the inwardly tapered end 20. When the collar 50 is in a relaxed state, the inner diameter D2 is consistent with the inner diameter D2 of the inner surface 38. Thus, the collar can sit on top of the coupling member 8. When the collar 50 is under enough pressure to close the gap 54, the inner diameter D2 is less than the outer diameter of the housing 3. One end of the collar 50 has an tapered edge 52 for coacting with the inwardly tapered end 20 of the receptacle 10.

In connecting the cover 2 to the microphone assembly 1, the coupling member 8 slidably receives the housing 3 into the bore 34. The coupling member is positioned on the housing 3 near the microphone 4, but preferably not contacting the microphone. The knurled grip 30 is positioned away from the microphone. The collar 50 is then placed over the microphone 4, tapered end last, and against the coupling member 8. The shield 6 is then placed over the microphone 4, receptacle end first, and received over the collar 50 and onto the coupling member 8. As the shield 6 is threadably tightened onto the coupling member 8, the annular tapered edge 52 of the collar 50 is forced against the inwardly tapered end 20 of the receptacle 10, causing the collar to constrict against the housing 3, thereby causing a snug frictional fit. Thus, the alternative embodiment also provides protection without interfering with the operation of the microphone 4.

It is contemplated that other means of coupling the shield 6 and coupling member 8 can be provided. For example, the shield 6 can include the above described resilient fingers 42 and the coupling member can fit over the resilient fingers 42 to provide the compression. These embodiments could be provided with or without a threaded coupling. Alternatively, the shield 6 can include an annular groove for receiving an annular rib of the coupling member 8, thereby providing the same friction fit as described above, but holding the coupling member 8 to the shield 6 with a snapping mechanism. Of course, the locations of the rib and groove can also be reversed to provide the same snapping mechanism.

The foregoing disclosure and description of the invention are illustrative and explanatory thereof, and various changes in the size, shape, materials, components, as well as in the details of the illustrated embodiments and construction and method of operation may be made without departing from the spirit of the invention.

I claim:

1. An apparatus for protecting a microphone, the microphone having a housing and a microphone sound receiver, wherein the housing has first and second ends and the microphone sound receiver is secured to the first end of the housing, the apparatus comprising:

a removable coupling engagable about the housing between the first and second ends; and a removable shield engagable to said coupling and about said microphone sound receiver, said shield and said coupling engagable to wedge against the housing, whereby frictionally securing said shield and coupling to the housing.

2. The apparatus of claim 1, wherein the coupling is tubular shaped and includes:

a plurality of longitudinal resilient fingers, each finger having a gripping end and an opposing shield-receiving end; and a grip integral with each gripping end for holding the plurality of longitudinal resilient fingers, wherein each finger is spaced apart from an adjacent finger so that a longitudinal slot is formed therebetween.

3. The apparatus of claim 2, wherein the plurality of longitudinal resilient fingers have male threads and the shield has female threads for matingly engaging the male threads, and wherein the female threads are tapered inwardly so that threading the female threads onto the male threads causes the plurality of longitudinal resilient fingers to press against the housing, frictionally securing the coupling to the housing.

4. The apparatus of claim 1, wherein one end of said shield is tubular shaped and includes a plurality of longitudinal resilient fingers, wherein each finger is spaced apart from an adjacent finger so that a longitudinal slot is formed therebetween.

5. The apparatus of claim 4, wherein the plurality of longitudinal resilient fingers have male threads and the coupling has female threads for matingly engaging the male threads, and wherein the female threads are tapered inwardly so that threading the female threads onto the male threads causes the plurality of longitudinal resilient fingers to press against the housing, frictionally securing the coupling to the housing.

6. The apparatus of claim 1, wherein said shield is sound permeable.

7. The apparatus of claim 1, wherein said shield and said coupling snap together.

8. The apparatus of claim 1, wherein said shield is sized to form a buffer zone about the microphone sound receiver, wherein said shield is constructed of a resilient material which deforms under impact into the buffer zone to absorb the impact.

9. The apparatus of claim 1, wherein said shield surrounds the microphone sound receiver.

10. The apparatus of claim 1, wherein said coupling is sizable and interchangeable to fit a variety of housing sizes and shapes.

11. The apparatus of claim 1, wherein said coupling includes an annular grip.

12. A method for protecting a microphone sound receiver for a microphone having said microphone sound receiver and a housing, the housing having first and second ends, the method comprising the steps of:

(a) forming a removable coupling engagable about the housing between the first and second ends;

(b) forming a removable shield engagable to said coupling and about said microphone sound receiver, said shield and said coupling engagable to wedge against the housing, whereby frictionally securing said shield and coupling to the housing;

(c) sliding the coupling onto the housing; and (d) engaging the shield with the coupling.

13. The method of claim 12, wherein step (a) further comprises the steps of:

(e) forming a plurality of longitudinal resilient fingers on said coupling, each finger having a gripping end and an opposing shield-receiving end; and (f) forming a grip integral with each gripping end on said coupling for holding the plurality of longitudinal resilient fingers, wherein each finger is spaced apart from an adjacent finger so that a longitudinal slot is formed therebetween.

14. The method of claim 13, wherein step (e) further comprises the step of:

(g) forming a male thread on said plurality of longitudinal resilient fingers, wherein step (b) further comprises the step of:

(h) forming an inwardly tapered female thread in said shield, and and wherein step (d) further comprises the steps of:

(i) threading the male threads into the female threads; and (j) causing the plurality of longitudinal resilient fingers to press against the housing to create a frictional fit.

15. The method of claim 12, wherein step (b) further comprises the step of:

(k) forming a plurality of longitudinal resilient fingers on one end of said shield, each finger being spaced apart from an adjacent finger so that a longitudinal slot is formed therebetween.

16. The method of claim 15, wherein step (k) further comprises the step of:

(l) forming a male thread on said plurality of longitudinal resilient fingers, wherein step (a) further comprises the step of:

(m) forming an inwardly tapered female thread in said coupling, and and wherein step (d) further comprises the steps of:

(n) threading the male threads into the female threads; and (o) causing the plurality of longitudinal resilient fingers to press against the housing to create a frictional fit.

17. The method of claim 12, wherein said shield is sound permeable.

18. The method of claim 12, wherein said shield is sized to form a buffer zone about the microphone sound receiver, wherein said shield is constructed of a resilient material which deforms under impact into the buffer zone to absorb the impact.

19. The method of claim 12, wherein said shield surrounds the microphone sound receiver.

20. The method of claim 12, wherein said coupling is sizable and interchangeable to fit a variety of housing sizes and shapes.

21. The method of claim 12, wherein said coupling includes an annular grip.

* * * * *